United States Patent [19]

Beech et al.

[11] Patent Number: 4,459,203

[45] Date of Patent: Jul. 10, 1984

[54] INCREASED GASOLINE OCTANE IN FCC REACTOR

[75] Inventors: James H. Beech, Thorofare; Benjamin Gross, Cherry Hill; Michael P. Ramage, Moorestown, all of N.J.

[73] Assignee: Mobil Oil Corporation, New York, N.Y.

[21] Appl. No.: 335,295

[22] Filed: Dec. 28, 1981

[51] Int. Cl.[3] ..... C10G 11/00

[52] U.S. Cl. ..... 208/113; 208/157

[58] Field of Search ..... 208/113, 157

[56] References Cited

U.S. PATENT DOCUMENTS

| | | | |
|---|---|---|---|
| 2,409,751 | 10/1946 | Gerhold et al. . | |
| 2,440,623 | 4/1948 | Voorhees . | |
| 2,488,033 | 11/1949 | Johnson . | |
| 2,905,629 | 9/1959 | Smith et al. | 208/127 |
| 3,042,196 | 7/1962 | Payton et al. | 208/113 |
| 3,074,878 | 1/1963 | Pappas | 208/127 |
| 3,243,265 | 3/1966 | Annesser . | |
| 3,617,496 | 11/1971 | Bryson et al. | 208/80 |
| 3,617,512 | 11/1971 | Bryson et al. | 208/120 |
| 3,650,946 | 3/1972 | Mourning | 208/120 |
| 3,706,654 | 12/1972 | Bryson et al. | 208/74 |
| 3,785,782 | 1/1974 | Cartmell | 208/165 X |
| 3,812,029 | 5/1974 | Snyder, Jr. | 208/113 |
| 3,835,029 | 9/1974 | Larson | 208/113 |
| 3,964,876 | 6/1976 | James | 208/74 X |
| 4,026,789 | 5/1977 | James | 208/74 |

*Primary Examiner*—Delbert E. Gantz
*Assistant Examiner*—O. Chaudhuri
*Attorney, Agent, or Firm*—Alexander J. McKillop; Michael G. Gilman; Stanislaus Aksman

[57] ABSTRACT

The operation of FCC apparatus is improved by decreasing oil partial pressure in the FCC reactor riser by about 10 psia, as compared to the normal oil partial pressure in the riser, thereby increasing octane rating of the gasoline produced in the FCC unit. The oil partial pressure may be reduced by injecting a suitable amount of an inert diluent into the riser, or by decreasing throughput of the FCC reactor.

16 Claims, 1 Drawing Figure

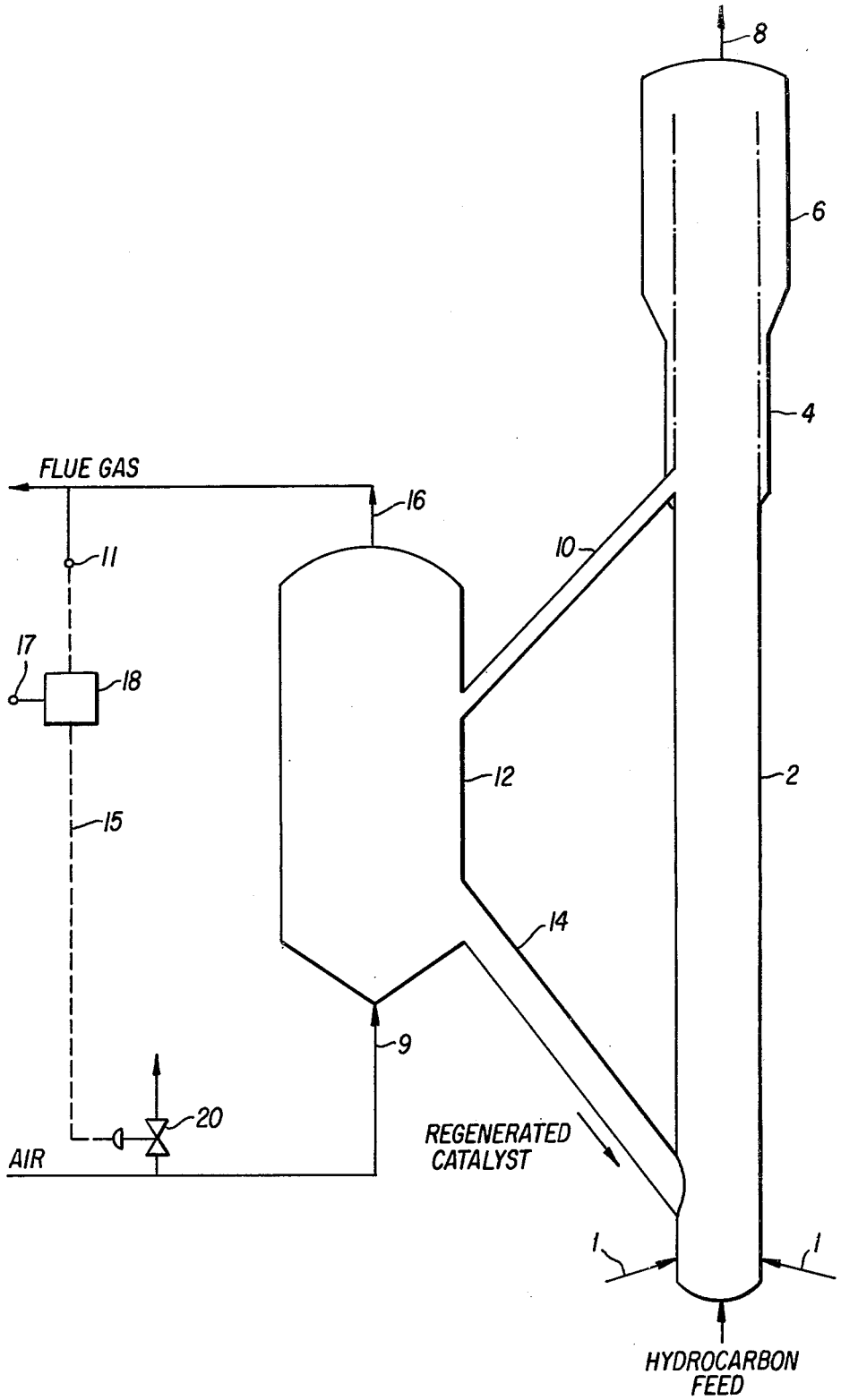
8
6
4
FLUE GAS
16
11
10
17
18
12
2
15
14
9
20
AIR
REGENERATED
CATALYST
1
1
HYDROCARBON
FEED

INCREASED GASOLINE OCTANE IN FCC REACTOR

BACKGROUND OF THE INVENTION

1. Field of the Invention

This invention relates to catalytic cracking of petroleum fractions. More particularly, this invention relates to an improved FCC process for converting petroleum fractions into valuable hydrocarbon products and coke.

2. Description of the Prior Art

Conversion of various petroleum fractions to more valuable products in catalytic reactors is well known in the art. The petroleum industry has found the use of a fluid bed catalytic cracking reactor (hereinafter FCC reactor) particularly advantageous for that purpose. An FCC reactor typically comprises a thermally balanced assembly of apparatus comprising the reactor vessel containing a mixture of regenerated catalyst and the feed and a regenerator vessel wherein spent catalyst is regenerated. The feed is converted in the reactor vessel over the catalyst, and coke simultaneously forms on the catalyst, thereby deactivating the same. The deactivated (spent) catalyst is removed from the reactor vessel and conducted to the regenerator vessel, wherein coke is burned off the catalyst with air, thereby regenerating the catalyst. The regenerated catalyst is then recycled to the reactor vessel. The reactor-regenerator assembly must be maintained in steady state heat balance, so that the heat generated by burning the coke provides sufficient thermal energy for catalytic cracking in the reactor vessel. The steady state heat balance is usually achieved and maintained in FCC reactors by controlling the rate of flow of the regenerated catalsyt from the regenerator to the reactor by means of an adjustable slide valve in the regenerator-to-reactor conduit.

The product stream of the catalytic cracker is usually fractionated into a series of products, including: gas, normally conducted to gas treatment plant; gasoline; light cycle gas oil; and heavy cycle gas oil. A portion of the heavy cycle gas oil is usually recycled into the reactor vessel and mixed with fresh feed. The bottom effluent of the fractionator is conventionally subjected to settling and the solid-rich portion of the settled product is also recycled to the reactor vessel in admixture with the heavy cycle gas oil and feed.

In a modern version of FCC reactor, the regenerated catalyst is introduced into the base of a riser reactor column in the reactor vessel. A primary purpose of the riser reactor is to crack the petroleum feed. The regenerated hot catalyst is admixed in the bottom of the riser reactor with a stream of fresh feed and recycled petroleum fractions, and the mixture is forced upwardly though the riser reactor. During the upward passage of the catalyst and of the petroleum fractions, the petroleum is cracked, and coke is simultaneously deposited on the catalyst. The coked catalyst and the cracked petroleum components are passed upwardly out of the riser and through a solid-gas separation system, e.g., a series of cyclones, at the top of the reactor vessel. The cracked petroleum fraction is conducted to product separation, while the coked catalyst, after steam stripping, passes into the regenerator vessel and is regenerated therein, as discussed above. Most of the cracking reactions in such modern FCC units take place in the riser reactor. Accordingly, the remainder of the reactor vessel is used primarily to separate entrained catalyst particles from the petroleum fractions.

Further details of FCC processes can be found in: U.S. Pat. Nos. 2,383,636 (Wurth); 2,689,210 (Leffer); 3,338,821 (Moyer et al); 3,812,029 (Snyder, Jr.); 4,093,537 (Gross et al); 4,118,337 (Gross et al); 4,118,338 (Gross et al), and, 4,218,306 (Gross et al), as well as in Venuto et al, Fluid Catalytic Cracking With Zeolite Catalysts, Marcel Dekher, Inc. (1979). The entire contents of all of the above patents and publications are incorporated herein by reference.

Performance characteristics of FCC reactors can be measured by a number of factors, e.g., percent conversion (usually in volume percent) of feed to all of the products of the FCC reactor, such as gasoline, coke and gas; selectivity which is a measure (also usually in percent volume) of the conversion of feed to gasoline grade products; and octane number of product gasoline. The production of higher octane gasoline is becoming increasingly important in modern refining. However, higher FCC gasoline octanes are usually difficult to obtain in conventional FCC installations without a corresponding loss in gasoline yield. The loss of gasoline yield cannot be tolerated, especially in view of relatively low profit margins realized by gasoline refiners under present economic conditions.

The use of steam, or other diluent vapors, for catalyst fluidization, unit start-up, residence time reduction and feed/catalyst mixing has been known in the FCC art. For example, James, U.S. Pat. Nos. 3,946,876 and 4,026,789, uses steam to help disperse the hydrocarbon material in the reactor vessel of an FCC plant. The steam also lowers the partial pressure of the hydrocarbon vapors to below about 20 pounds per square inch (e.g., column 4, lines 48–52 of the '789 patent). Several other patents also disclose the use of steam in the reactor to help fluidize the catalyst, aid in unit start-up, reduce residence time of the feed in the reactor and improve mixing of feed with the catalyst (e.g., Snyder, Jr., 3,812,029; Pappas, 3,074,878; Cartmell, 3,785,782; Payton, 3,042,196; and, Annesser, 3,243,265). However, there is no recognition in any of these patents that the addition of a certain, narrowly-defined amount of steam to the hydrocarbon feed in an FCC reactor, or the reduction of oil partial pressure in the reactor to within certain defined limits, may result in unexpected advantages achieved by this invention.

Accordingly, it is a primary object of the present invention to provide an improved process for producing gasoline having increased octane without the decrease of gasoline yield.

It is an additional object of this invention to provide a process for producing gasoline having increased octane by decreasing gaseous oil partial pressure in the FCC reactor riser.

These and other objects of this invention will become apparent to those skilled in the art from the study of the specification and appended claims.

SUMMARY OF THE INVENTION

Gasoline octane is improved without significant changes in conversion of coke or gasoline yield by decreasing the partial pressure of the hydrocarbonaceous feed in an FCC riser reactor by about 10 pounds per square inch absolute (psia), relative to the normal operating conditions of a given FCC unit.

BRIEF DESCRIPTION OF THE DRAWING

The FIGURE is a schematic representation of a typical FCC reactor containing injection nozzles for introducing a diluent gas into the reactor as one means of decreasing oil partial pressure.

DETAILED DESCRIPTION OF THE INVENTION

Oil partial pressure is reduced at or very near the point of the introduction of the feed into an FCC reactor. In the case of an FCC reactor containing a reactor riser, the oil partial pressure is preferably reduced in the riser at the point where the regenerated catalyst contacts the feed, or just upstream of that point. The oil partial pressure can be reduced by any convenient means, e.g., by injecting a diluent gas into the reactor, or by decrasing total operating pressure within the reactor, e.g., by reducing oil feed rate into the reactor.

Suitable diluents are inert gasses which can be introduced into the reactor by any conventional injection means. The term "inert gas" is used herein to encompass any gas which does not react chemically, in the presence of a typical FCC catalyst, with a typical feed of an FCC reactor, products thereof, or the catalyst. Examples of suitable diluent gasses are steam, nitrogen or helium.

Regardless of the method used for decreasing the oil partial pressure in the reactor, it is desirable to lower the oil partial pressure by about 5 to 10 psia, as compared to the oil partial pressure at which the FCC reactor usually operates. Thus, in a relatively small FCC installation, usually operating at less than about 50,000 barrels per day feed throughput and at oil partial pressure in the reactor of 35 to 40 psia, the oil partial pressure would be reduced in accordance with the present invention to 25–35 psia, preferably 27–34 psia and most preferably 29–33 psia. Conversely, in larger FCC units, operating at more than 50,000 barrels per day of feed throughput and at 40–45 psia oil partial pressure in the reactor, the oil partial pressure would be reduced to 30–40 psia, preferably 31–39 psia, and most preferably 33–38 psia. If a diluent gas is used to decrease the oil partial pressure, a sufficient amount thereof may be injected into the base of the reactor in order to bring the oil partial pressure to within the desired limits. For example, for an FCC reactor operating at about 32,000 barrels per day (BPD) of feed, and at oil partial pressure of 43.7 psia, about 8,000 pounds per hour of steam would be needed to drcrease the oil partial pressure to about 33.7 psia. It is estimated that the 10 psia decrease in the oil partial pressure would result in 2.0 units increase in the octane (measured as R+O) of the gasoline obtained from the FCC reactor. Similarly, in the case of a reactor operating at about 100,000 barrels per day of feed throughput, and at oil partial pressure of about 47.6 psia, the reduction of the feed rate to about 80,000 barrels per day results in the oil partial pressure of 42.1 psia, and an increase in the gasoline octane (R+O) of 2.0 units.

The oil partial pressure may be calculated from the feed rates of the hydrocarbon, the catalyst and/or the steam into the reactor if the FCC unit pressure is known.

In general, the process of this invention can be utilized with any conventional design of an FCC reactor, such as those disclosed in the references set forth on page 2 of this application. Similarly, the process of this invention can also be utilized with any conventionally-used catalytic cracking feeds, such as napthas, gas oils, vacuum gas oils, residual oils, light and heavy distillates and synthetic fuels.

Any conventionally used catalyst may also be used in the FCC reactor utilizing the present process. Suitable catalysts are, for example, those containing silica and silica alumina or mixtures thereof. Particularly useful are higher and lower activity zeolites, preferably low coke-producing crystalline zeolite cracking catalysts comprising faujasite, crystalline zeolites and other zeolites known in the art. If desired, a carbon monoxide promoter may also be used in the regenerator portion of the FCC reactor. Such carbon monoxide promoters are those conventionally used in the art, such as platinum, palladium, rhodium, iridium, osmium, and rhenium. The regeneration procedure for the catalyst used in this invention is also that conventionally used in the art, e.g., that of U.S. Pat. Nos. 3,748,251 and 3,886,060, the entire contents of both of which are incorporated herein by reference.

The invention will now be described in conjunction with one exemplary embodiment thereof illustrated in the Figure.

In reference to the Figure, representing a schematic flow diagram of one manner of applying the present invention to an exemplary FCC unit, a hydrocarbonaceous feed is introduced at the bottom of the riser reactor 2. Hot regenerated catalyst is also introduced to the bottom of the riser by a standpipe 14, usually equipped with a flow control valve, not shown for clarity. The feed volatilizes almost instantaneously, and it forms a suspension with the catalyst which proceeds upwardly in the reactor. The suspension formed in the bottom section of the riser is passed upwardly through the riser under selected temperature and residence time conditions. A diluent, such as steam, is introduced through at least two nozzles 1 into the riser, just upstream of the point at which the regenerated catalyst contacts the feed. The suspension then passes into a generally wider section of the reactor 6 which contains solid-vapor separation means, such as a conventional cyclone, and means for stripping entrained hydrocarbons from the catalyst. Neither the stripping section, nor the solid-gas separation equipment is shown in the drawing for clarity. Such equipment is that conventionally used in catalytic cracking operations of this kind and its construction and operation, it is believed, will be apparent to those skilled in the art. The vapor separated in the cyclone and in the stripping means, including the diluent vapor, is withdrawn from the reactor by a conduit 8.

Stripped catalyst containing carbonaceous deposits or coke is withdrawn from the bottom of the stripping section through a conduit 10 and conducted to a regeneration zone or vessel 12. In the regeneration zone the catalyst is regenerated by passing an oxygen-containing gas, such as air, through a conduit 9, burning the coke off the catalyst in a regenerator 12 and withdrawing the flue gasses from the regenerator by a conduit 16.

It will be obvious to those skilled in the art that the FCC installation incorporating the present invention contains a number of conventional control loops, normally used in FCC reactors to control the operation of the process and maintain operating parameters thereof within the desired limits. One such exemplary control loop controlling the flow of oxygen into the regenerator is shown in the Figure. The amount of oxygen in the flue gas is measured by a composition sensor 11 which transmits a signal indicative of the oxygen concentration to the controller 18. The controller 18, equipped with a setpoint 17, places a signal on line 15, which signal is indicative of the deviation of the oxygen composition of the flue gas from the predetermined value of the setpoint 17 (usually 0 to 1.0% by mole). A control valve 20 is adjusted in a direction to reduce the deviation of the measured composition from the predetermined composition as defined by the setpoint 17. Accordingly, if the amount of oxygen in the flue gas exceeds the level predetermined and preset at the setpoint 17, the degree of opening of the valve 20 will increase, thereby also decreasing the amount of oxygen introduced into the regeneration zone through a conduit 9. Conversely, the degree of opening of the valve 20 will decrease, thereby increasing the amount of oxygen permitted to enter regeneration zone 12, if the amount of oxygen detected in the flue gas by the sensor 11 is below that preset at the setpoint 17.

As mentioned above, the process of the present invention can be used in conjunction with any prior art FCC reactor. Accordingly, the following examples illustrating the use of the present invention in conjunction with particular installations are not intended to be a limitation of the scope or application of the present invention.

EXAMPLE I

A pilot plant riser reactor FCC unit, having operating parameters set forth in Table A below and operating with a conventional FCC catalyst and feed (e.g., 650° F.+boiling point gas oil), was used in this experiment. Table A summarizes five sets of test data (runs 1–5) obtained from this unit before its operation was modified. Table B summarizes three sets of test data (runs 6–8) obtained from the unit after the unit pressure was decreased. As a result of the decrease in unit pressure, oil partial pressure in the reactor decreased by about 9 to about 12 psia and gasoline octane (R+O) increase by about 1.0 to about 2.0 units.

The octane number of the gasoline produced in the installation (R+O) is increased as a result of the change by 2.0 numbers, as set forth in the table below.

| | High Oil Partial Pressure (Without Steam Injection) | Low Oil Partial Pressure (With Steam Injection) |
|---|---|---|
| Fresh Feed, BPD × 1000 | 32.0 | 32.0 |
| Steam Injection, lb/hr | 0 | 7,855 |
| Reactor Temp., °F. | 1,000 | 1,000 |
| Reactor Pressure, psig | 29.0 | 29.0 |
| Partial Pressure, psia | 43.7 | 33.7 |
| Octane (R + O) | base | base + 2.0 |

EXAMPLE III

The operation of a larger FCC installation, normally processing about 100,000 barrels per day of the same feed as in Example II, is modified in a manner similar to that of the installation of Example II, above, i.e., by providing nozzles for injecting steam as a diluent into the bottom of the riser. The amount of the steam injected, as seen from Table 1 below, is relatively the same as that in Example II—about 3% of the total feed.

The 2.0 number increase in octane, as the result of the change, is also similar to that for the FCC unit of Example II. However, the necessity of using about 22,000 pounds per hour of steam to decrease the oil partial pressure from 47.6 to 37.6 psia may not be technically and/or commercially feasible. Accordingly, it is attempted to reduce the oil partial pressure by a comparable amount by decreasing the rate of introduction of the feedstock into the FCC unit. The results of that change are illustrated in Table 2 below. Table 2 summarizes the results of about a 20% decrease in the feed rate from 100,000 barrels per day to about 80,000 barrels per day. As the result of that change the oil partial pressure in the reactor is decreased by about 5.5 psia, and the gasoline octane (R+O) increased by about 2.0 units.

| | TABLE A | | | | | TABLE B | | |
|---|---|---|---|---|---|---|---|---|
| | Run Number | | | | | | | |
| OPERATING CONDITIONS | 1 | 2 | 3 | 4 | 5 | 6 | 7 | 8 |
| Catalyst/Oil Ratio By Weight | 5.2 | 5.5 | 6.3 | 7.1 | 7.4 | 6.0 | 7.1 | 7.6 |
| Cat. Res. Time., Sec. | 10.2 | 10.1 | 9.9 | 10.8 | 10.5 | 10.8 | 10.9 | 11.0 |
| Oil Res. Time., Sec. | 5.7 | 5.6 | 5.5 | 6.0 | 5.8 | 6.0 | 6.1 | 6.1 |
| Oil Partial Pressure Reactor Inlet, PSIA | 48.6 | 48.5 | 47.8 | 47.6 | 48.6 | 39.3 | 39.6 | 39.8 |
| Oil Inlet Temp., °F. | 564 | 567 | 562 | 564 | 564 | 570 | 570 | 569 |
| Cat. Inlet Temp., °F. | 1243 | 1244 | 1184 | 1169 | 1163 | 1192 | 1161 | 1167 |
| Calculated feed and Catalyst Mix Temp. at Bottom of Riser, °F. | 980 | 992 | 971 | 978 | 979 | 971 | 973 | 987 |
| Weighted Average Reactor Temp., °F. | 963 | 963 | 962 | 963 | 962 | 964 | 965 | 964 |
| Octane of $C_{5+}$ Gasoline, R + O | 86.0 | 86.4 | 86.1 | 86.1 | 86.3 | 87.9 | 87.8 | 87.4 |
| Reactor Pressure, PSIG | 47.5 | 47.0 | 50.0 | 50.0 | 50.0 | 34.0 | 37.0 | 37.0 |

EXAMPLE II

An FCC installation, normally operating at a throughput of about 32,000 barrels per day (BPD) of 650° F.+boiling point gas oil, and having other operating parameters as set forth in the table below, is modified by installing steam jets at the bottom of the riser reactor (similar to those shown in the Figure) for injecting steam. The steam is injected at the rate of 7,855 pounds per hour (lb/hr), thereby decreasing the oil partial pressure in the riser from 43.7 psia to 33.7 psia.

Accordingly, it is apparent that the same benefits can be obtained in the practice of the present invention, regardless of the manner in which the oil partial pressure is decreased.

TABLE 1

| | High Oil Partial Pressure | Low Oil Partial Pressure |
|---|---|---|
| Fresh Feed, BPD × 1000 | 100.0 | 100.0 |
| Steam Injection, lb/hr | 205 | 21,866 |
| Reactor Temp., °F. | 960 | 960 |

TABLE 1-continued

| | High Oil Partial Pressure | Low Oil Partial Pressure |
|---|---|---|
| Reactor Pressure, psig | 33.0 | 33.0 |
| Oil Partial Pressure, psia | 47.6 | 37.6 |
| Octane (R + O) | base | base + 2.0 |

TABLE 2

| | High Oil Partial Pressure | Low Oil Partial Pressure |
|---|---|---|
| Fresh Feed, BPD × 1000 | 100.0 | 80.3 |
| Steam Injection, lb/hr | 205 | 184 |
| Reactor Temp., ° F. | 960 | 960 |
| Reactor Pressure, psig | 33.0 | 27.3 |
| Oil Partial Pressure, psia | 47.6 | 42.1 |
| Gasoline Octane (R + O) | base | base + 2.0 |

It will be apparent to those skilled in the art that the specific embodiments discussed above can be successfully repeated with ingredients equivalent to those generically or specifically set forth above and under variable process conditions.

From the foregoing specification one skilled in the art can readily ascertain the essential features of this invention and without departing from the spirit and scope thereof can adopt it to various diverse applications.

What is claimed is:

1. In a fluid catalytic cracking process comprising admixing a hydrocarbonaceous feed, flowing at the rate of at least 50,000 barrels per day, with a regenerated catalyst in the bottom section of a reactor riser sized to process at least 50,000 barrels of the feed per day, passing the mixture of the hydrocarbonaceous feed and the catalyst through the riser, thereby at least partially volatilizing the hydrocarbonaceous feed and effecting cracking thereof at the process temperature under endothermic process conditions and deactivating the catalyst by deposition of carbonaceous deposits thereon, separating the deactivated catalyst from the cracked hydrocarbonaceous feed, passing the deactivated catalyst to a regenerator vessel wherein the carbonaceous deposits are removed from the deactivated catalyst under exothermic process conditions by means of a regenerating medium introduced into the regenerator vessel, and passing the regenerated hot catalyst to the bottom section of the reactor riser, the improvement wherein the partial pressure of the hydrocarbonaceous feed in the riser is about 30 to about 40 psia, thereby increasing octane of gasoline produced in the fluid catalytic process.

2. A process according to claim 1 wherein the partial pressure of the hydrocarbonaceous feed is about 31 to about 39 psia.

3. A process according to claim 2 wherein the partial pressure of the hydrocarbonaceous feed is about 33 to about 38 psia.

4. A process according to claim 1 wherein a diluent gas is injected into the bottom section of the reactor riser in a sufficient quantity to maintain the hydrocarbonaceous feed partial pressure at about 30 to about 40 psia.

5. A process according to claim 4 wherin the diluent gas is steam.

6. A process according to claim 4 wherein the diluent gas is nitrogen.

7. A process according to claim 2 wherein a diluent gas is injected into the bottom section of the reactor riser in a sufficient quantity to maintain the hydrocarbaneceous feed partial pressure at about 31 to about 39 psia.

8. A process according to claim 3 wherein a diluent gas is injected into the bottom section of the reactor riser in a sufficient quantity to maintain the hydrocarboneceous feed partial pressure at about 33 to about 38 psia.

9. In a fluid catalytic cracking process comprising admixing a hydrocarbonaceous feed, flowing at the rate of less than 50,000 barrels per day, with a regenerated catalyst in the bottom section of a reactor riser sized to process less than 50,000 barrels of the feed per day, passing the mixture of the hydrocarbonaceous feed and the catalyst through the riser, thereby at least partially volatilizing the hydrocarbonaceous feed and effecting cracking of the hydrocarbonaceous feed at the process temperature under endothermic process conditions and deactivating the catalyst by the deposition of carbonaceous deposits thereon, separating the deactivated catalyst from the cracked hydrocarbonaceous feed, passing the deactivated catalyst to a regenerator vessel wherein the carbonaceous deposits are removed from the deactivated catalyst under exothermic process conditions by means of a regenerating medium introduced into the regenerator vessel, and passing the regenerated hot catalyst to the bottom section of the reactor riser, the improvement wherein the partial pressure of the hydrocarbonaceous feed in the riser is about 25 to about 35 psia, thereby increasing octane of gasoline produced in the fluid catalytic process.

10. A process according to claim 9 wherein the partial pressure of the hydrocarbonaceous feed is about 27 to about 34 psia.

11. A process according to claim 10 wherein the partial pressure of the hydrocarbonaceous feed is about 29 to about 33 psia.

12. A process according to claim 9 wherein a diluent gas is injected into the bottom section of the reactor riser in a sufficient quantity to maintain the hydrocarbonaceous feed partial pressure at about 25 to about 35 psia.

13. A process according to claim 12 wherein the diluent gas is steam.

14. A process according to claim 12 wherein the diluent gas is nitrogen.

15. A process according to claim 10 wherein a diluent gas is injected into the bottom section of the reactor riser in a sufficient quantity to maintain the hydrocarbaneceous feed partial pressure at about 27 to about 34 psia.

16. A process according to claim 11 wherein a diluent gas is injected into the bottom section of the reactor riser in a sufficient quantity to maintain the hydrocarbaneceous feed partial pressure at about 29 to about 33 psia.

* * * * *